United States Patent [19]

Semian et al.

[11] 4,453,052

[45] Jun. 5, 1984

[54] ADJUSTABLE PRESSURE SWITCH

[75] Inventors: David W. Semian, One S. Park St., Madison, Wis. 53715; Patric C. Quirke, Marshall, Ill.

[73] Assignee: David W. Semian, Madison, Wis.

[21] Appl. No.: 351,520

[22] Filed: Feb. 23, 1982

[51] Int. Cl.[3] ..... H01H 3/14

[52] U.S. Cl. ..... 200/85 R; 200/52 R; 200/DIG. 2; 200/159 R

[58] Field of Search ..... 200/83 N, 85 R, 159 R, 200/159 B, 52 R, DIG. 2

[56] References Cited

U.S. PATENT DOCUMENTS

| | | | |
|---|---|---|---|
| 2,339,495 | 1/1944 | McMann | 200/85 R X |
| 3,602,677 | 8/1971 | Adelson et al. | 200/159 B X |
| 3,643,041 | 2/1972 | Jackson | 200/159 B X |
| 3,826,885 | 7/1974 | Allen et al. | 200/83 N X |
| 4,005,296 | 1/1977 | Olson | 200/85 R |

*Primary Examiner*—J. R. Scott

*Attorney, Agent, or Firm*—Isaksen, Lathrop, Esch, Hart & Clark

[57] ABSTRACT

An adjustable pressure switch is disclosed which has a generally cylindrical plastic case with a cylindrical cavity formed in one side. A mating, cylindrical pressure plate fits within the cavity and is spaced away from the bottom of the cavity by a resilient annular member. A top electrical contact member is mounted to the pressure plate and a bottom electrical contact member is mounted in the case, with the two contact members being normally maintained in spaced relation by the resilient member. A compression ring fitting within a groove in the cavity in the case holds the pressure plate firmly in position. Force applied to the pressure plate urges the same toward the bottom of the cavity until the two contact members make electrical contact. The amount of force required to close the switches can be adjusted by adjusting the position of the top contact member, formed as a set screw threaded into the pressure plate, or by selecting the shape or material of the resilient annular member.

18 Claims, 8 Drawing Figures

ADJUSTABLE PRESSURE SWITCH

FIELD OF THE INVENTION

This invention pertains generally to the field of electrical switches and particularly to switches which respond to contact or pressure.

BACKGROUND OF THE INVENTION

Electrical switches which are responsive to physical forces are used in a wide variety of applications. In some particular applications, it is desired that the switch respond to a predetermined amount of force or pressure so that the contacts of the switch are closed only after the threshold force on the closure member of the switch is exceeded. A typical construction for such a switch employs a metal contact which is cantilevered or otherwise suspended so that it will deflect under pressure toward the other contact. A pressure switch with such a construction may be subject to metal fatigue if the switch is used often, and such switches are not easily adjusted to select the amount of force required to trip the switch.

While many pressure responsive switches are available commercially now, there is a particular need for an adjustable pressure switch which is simple, lightweight and compact, inexpensive, easily adjustable in the amount of pressure required to trip the switch, and reliable over an extended period of use.

DISCLOSURE OF THE INVENTION

The pressure switch of the invention is formed of a simple assemblage of parts which nonetheless provides a compact and finely adjustable pressure switch which can be set to respond to a wide variety of pressures. The switch is well adapted for use in detecting the weight of an object, and can be used to detect the weight of a human being. Because the switch is so light and compact, it can even be placed within a specially designed shoe to be worn by a person who must control the amount of weight that he places upon his foot. The switch will close and provide a warning when the weight is exceeded. Similarly, the switch can be used in other situations where a pressure responsive switch of this nature is required, such as in applications where it is desirable to known that a certain safe operating weight limit has been exceeded.

The pressure switch includes a case formed of a rigid plastic insulator which has a central cylindrical cavity formed in one side with bottom and side walls. A bottom electrical contact member is mounted in the case and extends from the bottom of the cavity to the outside of the case where it is exposed for connection to a wire. A pressure plate having an outermost periphery conforming to the side walls of the cavity is mounted in the cavity and can slide up and down therein. A resilient insulating member is mounted between the pressure plate and the bottom of the cavity. A top contact member is mounted to the pressure plate and extends therethrough to terminate at a position spaced slightly away from the bottom contact member. The pressure plate is held from falling out of the cavity by a metal compression ring which engages a groove formed in the side walls of the cavity and presses against a flange formed about the periphery of the pressure plate. The top contact member is preferably formed as a set screw threaded in a hole in the center of the pressure plate, with the bottom of the set screw normally spaced slightly away from the head of the bottom contact. As pressure is placed on the plate, whose top surface extends slightly above the top of the case, the resilient member is compressed and allows the end of the top contact member to approach and ultimately touch the bottom contact member, thereby completing an electrical connection.

The amount of force which is required on the pressure plate to cause the contacts to touch can be adjusted by turning the set screw top contact to move it either closer to or further away from the head of the bottom contact. Since the resilient member will compress in direct relation to the force applied to it, the closer the two contacts are together initially, the less force will be required on the pressure plate to cause the contacts to touch. In addition, the resilient member itself may be selected to provide a desired range of forces which will cause the switch to close. The force required to close the contacts will depend on the resiliency of the material forming the resilient member and the size and shape of the member. The resilient member may be composed of a number of parts, such as concentric O-rings, wherein the number of rings can be chosen to achieve the desired range of forces required to close the switch.

The pressure switch of the invention can be made very compact, in the range of an inch in diameter or less and one half inch in thickness, very light, and extremely inexpensive compared to standard commercial pressure switches. In addition, the switch is capable of being adjusted over a wide range of pressure forces to adapt it to a great variety of uses.

Further objects, features, and advantages of the invention will be apparent from the following detailed description taken in conjunction with the accompanying drawings showing a preferred embodiment of the invention.

BEST MODE FOR CARRYING OUT THE INVENTION

Figure 1:
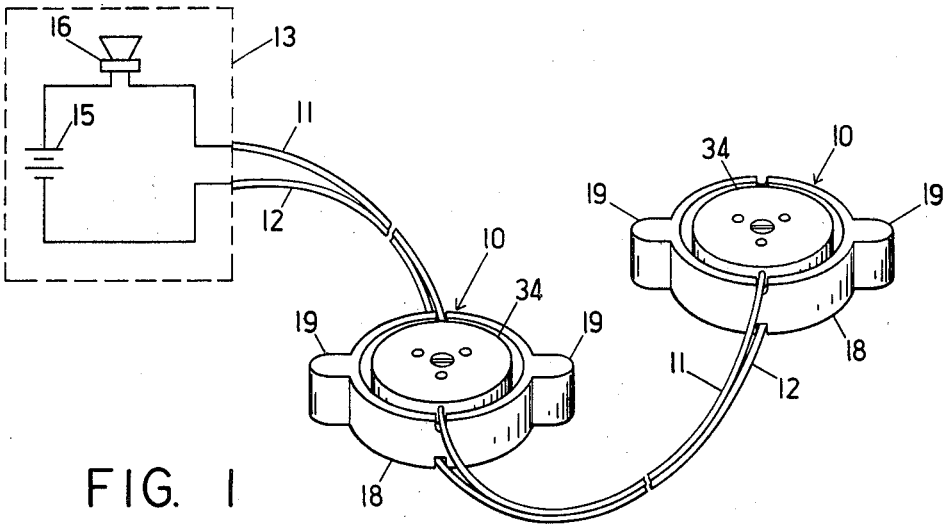
FIG. 1 is a perspective view of two adjustable pressure switches in accordance with the invention connected together by electrical wiring in an illustrative circuit to be used as a warning of excess pressures.

With reference to the drawings, two adjustable pressure switches in accordance with the invention are shown generally at 10 in FIG. 1. The two switches 10 are connected in parallel between a pair of electrical wires 11 and 12 which lead to a responding circuit shown for illustrative purposes within the dashed line labeled 13. To illustrate a use of the pressure switches, the circuit 13 includes a battery 15 and a speaker or sound generating device 16. Closure of either one of the switches causes current to flow through the wires 11 and 12 to activate the sounding device 16. Obviously, the switches 10 are not limited to use in such an enunicating circuit, but may find other uses whereever pressure switches are required. As illustrated in FIG. 1, two or more pressure switches may be connected in parallel so that pressure applied to any one of them will cause completion of the circuit.

The pressure switches 10 are compact and well adapted to a variety of purposes. However, one use for which they are particularly suited is for detecting the weight applied by a human being, as, for example, by being implaced in the sole of a special shoe which has openings into which the switches 10 fit. A hard sole piece may then be placed over the two switches. The switches may be set to complete the circuit when the person applies a preselected amount of pressure to either one of the switches, thereby providing a warning that too much pressure is being applied to the foot. Thus, people who have had leg or foot surgery, or for other reasons must control the amount of pressure that they place on their feet, can be warned when they are placing too much pressure on the limb. To especially adapt the pressure switch to such applications, the generally cylindrical case 18 of the switch 10 has a pair of protruding stablizers extending outward from the periphery of the case on opposite sides thereof. The protrusions 19 prevent the switch from twisting or turning when implaced within the shoe.

Figure 2:
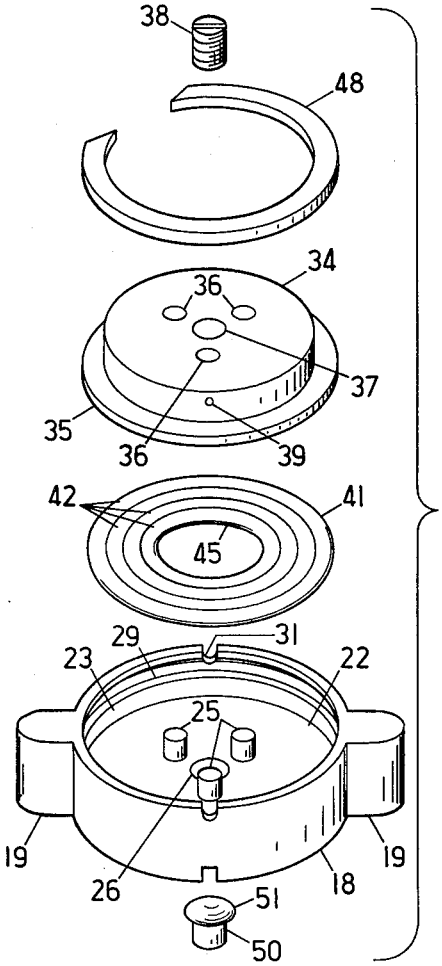
FIG. 2 is an exploded view showing the parts forming the pressure switch of the invention.
Figure 3:
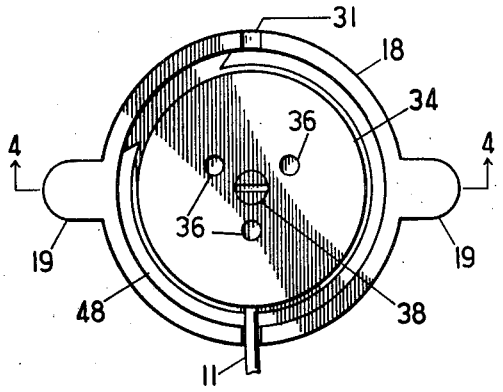
FIG. 3 is a top view of the pressure switch.
Figure 5:
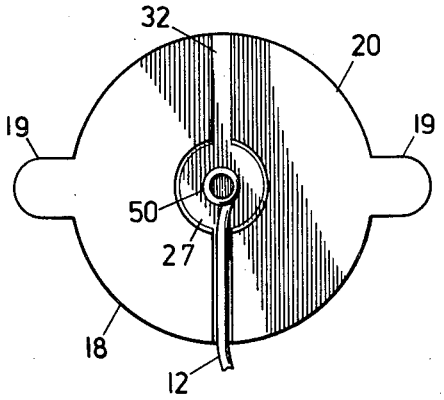
FIG. 5 is a bottom view of the pressure switch of FIG. 3.
Figure 6:
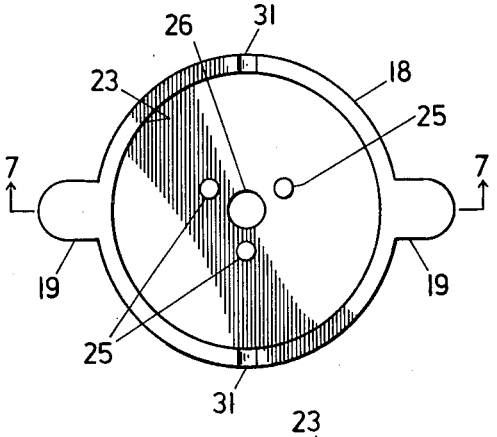
FIG. 6 is a top view of the case portion of the pressure switch of the invention.
Figure 7:
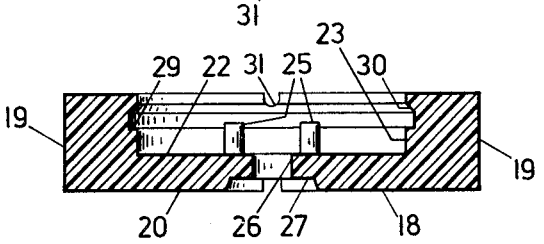
FIG. 7 is a cross-sectional view of the case taken along the lines 7—7 of FIG. 6.

The case 18 is better shown in a perspective view in FIG. 2, which shows the various parts of the switch in exploded relation. The case 18 itself has a generally cylindrical exterior with a flat bottom side 20, best shown in FIG. 5, with a cylindrical cavity being formed on the other side having a flat bottom wall 22 and a generally cylindrical side wall 23, as best shown in the views of FIGS. 6 and 7. The case is preferably formed of a strong, rigid plastic which is a good electrical insulator, such as acetal plastic available from DuPont under the name Delrin. Three upright posts are formed integrally with the case and extend upwardly from the bottom 22 of the cavity in evenly spaced relation about a central opening 26 formed in the case; the opening 26 extends from the bottom wall 22 of the cavity to the bottom side 20 of the case. A widened, countersunk depression 27 is formed in the bottom 20 of the case about the opening 26. A groove 29 is formed in the cylindrical wall 23 of the cavity at a position intermediate the bottom of the cavity and the top of the case. The groove 29 preferably has an upper beveled portion 30, as best shown in FIG. 7, for reasons explained below. The top of the case has indentations 31 formed therein to allow one of the conducting wires, such as the wire 11, to pass though the wall of the case rather than over the side of the wall, and the bottom side 20 has a lengthwise groove 32 formed therein to admit one of the conducting wires, such as the wire 12.

A generally cylindrical pressure plate 34 is formed with a flange 35 at the bottom thereof which has an outer periphery shaped and sized to conform to the inner periphery of the wall 23 of the cavity. The plate 34 is preferably formed of a good conducting metal, such as aluminum, and has three openings 36 formed therein which are shaped to admit the posts 25. The plate also has a central opening 37 extending from its top to its bottom which is tapped. The threads within the hole 37 are adapted to engage a top contact member set screw 38 which when threaded into the hole 37, makes good electrical contact with the plate 34. Holes 39 are preferably drilled in opposite sides of the upper cylindrical periphery of the plate 34 to allow the wires 11 to be inserted therein to provde an electrical contact between the wire and the plate. The wires may be soldered into the holes 39 or simply inserted and pressed in place by pressing on the top surface of the plate above the hole 39 to deform the hole and press the wire within the hole.

Figure 4:
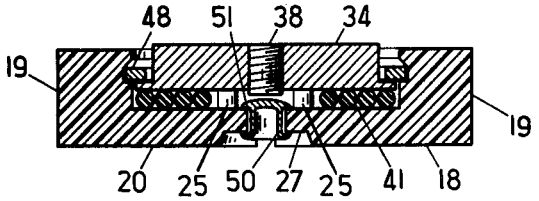
FIG. 4 is a cross-sectional view thereof taken along the lines 4—4 of FIG. 3.
Figure 8:
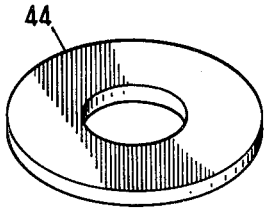
FIG. 8 is a perspective view of a one-piece resilient insulating member.

A resilient annular member 41, which is also a good electrical insulator, is mounted in the cavity between its bottom wall 22 and the bottom of the plate 34. The position of the annular resilient member 41 when the switch is assembled is best shown in the cross-sectional view of FIG. 4. The resilient member 41 may be formed of a plurality of concentric O-rings 42, as shown in FIGS. 2 and 4, or as a single flat annular member 44, as shown in FIG. 8. The central opening 45 of the annular member 41 fits around the posts 25, and the outer periphery of the member 41 is slightly smaller than the radius of the wall 23 of the cavity. The pressure plate 34 is held in the cavity and against the resilient member 41 by a compression or snap ring 48 formed as an incomplete circular annulus, as shown in FIG. 2. The ring 48 is compressed and placed on top of the flange 35 of the plate 34, and then released so that it fits within the groove 29 in the wall of the cavity, as shown in FIG. 4. As illustrated in that figure, the compression ring 48 preferably abuts up against the beveled portion 30 of the grove 29 so that the compression ring experiences a downward force which it transmits to the top of the flange 35, thereby firmly holding the pressure plate in place against the resilient member 41.

A bottom electrically conductive member 50 is mounted to the case within the hole 26, and has a contact head 51 extending up above the bottom of the cavity within the case. The metal contact member 50 may be formed, as shown, as a rivet which fits within the hole 26 and has its bottom end crimped back over to hold the member 50 in place. The crimping of the rivet-like contact member 50 may conveniently be used to attach the wire 12 to the contact member, since a bare portion of the wire may be held underneath the crimped portion of the rivet.

With reference to FIG. 4, it is seen that the bottom of the top contact member 38 is spaced just away from the top of the head 51 of the bottom contact member 50. The pressure plate 34, in its normal position, has its top surface spaced just above the top of the case 18. Thus, pressure applied from above to the pressure switch will press upon the pressure plate 34 to push it downwardly in the cavity, compressing the resilient member 41. The distance that the pressure plate 34 moves downwardly in the cavity will be approximately directly related to the amount of force applied to the pressure plate, since the resilient member 41 acts as a very stiff spring. However, forces may be applied to the pressure plate 34 which compress the resilient member 41 in a manner such that the downward movement of the pressure plate is directly related to the pressure but in an increasingly non-linear manner. If the plate 34 is depressed far enough toward the bottom of the cavity, the bottom of the top contact member 38 will touch the head 51 of the bottom contact member 50, completing a circuit between the wires 11 and 12. The amount of force applied to the pressure plate 34 that results in contact between the members 38 and 50 can be adjusted by turning the member 38 to move it closer to or further away from the bottom contact 50. If it is turned closer to the contact 50, less force applied to the plate will be required before contact is made. It is not necessary that the amount of deflection of the pressure plate 34 be linearly related to the amount of pressure applied to the plate, since the set-screw electrical contact 38 can be adjusted so that it will contact the member 50 at any desired pressure. In fact, it is highly desirable to have the very stiff, non-linearly increasing pressure relationship provided by the resilient annular member 41, since this allows the pressure switch to be adjusted over a very wide range of pressures.

The range of pressures over which the switch is useful can also be well adjusted by choosing the shape and material of the resilient member. For example, the number of O-rings which form the resilient member may be increased or decreased to give a desired range of pressures. A single O-ring may be used as the resilient annular member to provide a pressure switch which will be sensitive to very light pressures. By increasing the number of O-rings that form the resilient member 41, the upper pressure limit that the pressure switch can detect is increased. The O-rings are formed of readily available common resilient materials which also are usually good insulators, such as Buna N rubber, Neoprene, Viton, and natural rubber. Such materials are also available in varied hardness of durometer, so that the material forming the resilient member can also be selected so as to provide the desired range of pressures to be detected. The alternative single annular member 44, can be selected in varying widths, thicknesses, materials, and hardness to yield a desired pressure range.

The adjustable switch of the invention is thus very easily assembled of readily available materials which are well adapted to mass production. The construction of the switch yields extreme reliability, since there are very few moving parts and the only portion of the switch that is substantially stessed is the resilient member 41. This member is placed under compression, but is very slightly distorted, so that it is to be expected that the material may be subjected to frequent stressings over an almost indefinite period of time without suffering structural damage.

It is understood that the invention is not confined to the particular construction and arrangement of parts herein illustrated and described, but embraces such modified forms thereof as come within the scope of the following claims.

What is claimed is:

1. A pressure responsive switch, comprising:

(a) a case made of a rigid insulating material with a cavity formed in one side having a bottom wall and a peripheral side wall;

(b) an electrically conductive bottom contact member mounted in the case which extends from the bottom wall of the cavity to the outside of the case where it is exposed for connection to an electrical wire;

(c) a pressure plate having an outermost periphery conforming to the side wall of the cavity in the case, the pressure plate being mounted in the cavity in the case for up and down movement therein;

(d) an electrically insulating resilient annular member having a central aperture and comprised of a plurality of concentric O-rings formed of an elastomer material mounted between the pressure plate and the bottom wall of the cavity;

(e) means for holding the pressure plate in the cavity in the case and in contact with the resilient member while allowing the pressure plate to be moved toward the bottom of the cavity whereby the resilient member will be compressed by the pressure plate; and (f) an electrically conductive top contact member mounted to the pressure plate having one end in opposed relation to the bottom contact mounted in the case and in position to make contact with the bottom contact member as the pressure plate is moved toward the bottom of the cavity, the top contact member adapted to be connected to an external electrical circuit.

2. The pressure switch of claim 1 wherein the pressure plate has a central opening formed therein which is threaded, and wherein the top contact member is formed as a set screw threadingly engaged to the threads in the hole in the pressure plate which can be turned to move toward and away from the bottom contact member to allow the amount of force required on the pressure plate to cause contact between the conductive members to be varied.

3. The pressure switch of claim 1 wherein the cavity in the case is cylindrical, having a flat bottom wall and cylindrical peripheral wall, and wherein the pressure plate is cylindrical and has a cylindrical outermost periphery.

4. The pressure switch of claim 1 wherein the case is integrally formed of acetal plastic.

5. The pressure switch of claim 1 wherein the resilient member is annular in form.

6. The pressure switch of claim 1 wherein the resilient member comprises a plurality of concentric O-rings formed of an elastomer material.

7. The pressure switch of claim 1 wherein the pressure plate has a cylindrical outermost periphery and cylindrical side wall, is formed of conductive metal, and has a hole in the cylindrical side wall, and including an electrical wire fixed in the hole in the side wall of the pressure plate to make electrical contact with the plate, the plate having a central opening with threads therein, and wherein the top contact member is formed as a metal set screw threaded into the central opening in the pressure plate to make good electrical contact with the pressure plate.

8. A pressure responsive switch, comprising:

(a) a case made of a rigid insulating material with a cavity formed in one side having a bottom wall and a peripheral side wall, wherein the bottom wall of the cavity in the case is flat and wherein the case includes a plurality of integrally formed posts extending away from the bottom of the cavity in evenly spaced relation;

(b) an electrically conductive bottom contact member mounted in the case which extends from the bottom wall of the cavity to the outside of the case where it is exposed for connection to an electrical wire;

(c) a pressure plate having an outermost periphery conforming to the side wall of the cavity in the case, the pressure plate being mounted in the cavity in the case for up and down movement therein, wherein a plurality of holes are formed in the pressure plate which are adapted to admit the posts therethrough so that the pressure plate engages the posts and is held thereon to prevent the pressure plate from turning or twisting within the case;

(d) an electrically insulating resilient annular member having a central aperture mounted between the pressure plate and the bottom wall of the cavity;

(e) means for holding the pressure plate in the cavity in the case and in contact with the resilient member while allowing the pressure plate to be moved toward the bottom of the cavity whereby the resilient member will be compressed by the pressure plate; and (f) an electrically conductive top contact member mounted to the pressure plate having one end in opposed relation to the bottom contact mounted in the case and in position to make contact with the bottom contact member as the pressure plate is moved toward the bottom of the cavity, the top contact member adapted to be connected to an external electrical circuit.

9. A pressure responsive switch, comprising:

(a) a case made of a rigid insulating material with a cavity formed in one side having a bottom wall and a peripheral side wall;

(b) an electrically conductive bottom contact member mounted in the case which extends from the bottom wall of the cavity to the outside of the case where it is exposed for connection to an electrical wire;

(c) a pressure plate formed of a conductive metal having an outermost periphery conforming to the side wall of the cavity in the case, the pressure plate being mounted in the cavity in the case for up and down movement therein and being connected to an electrical wire;

(d) an electrically insulating resilient annular member having a central aperture mounted between the pressure plate and the bottom wall of the cavity;

(e) means for holding the pressure plate in the cavity in the case and in contact with the resilient member while allowing the pressure plate to be moved toward the bottom of the cavity whereby the resilient member will be compressed by the pressure plate; and (f) an electrically conductive top contact member mounted to the pressure plate and in electrical contact therewith and having one end in opposed relation to the bottom contact mounted in the case and in position to make contact with the bottom contact member as the pressure plate is moved toward the bottom of the cavity.

10. A pressure responsive switch, comprising:

(a) a case made of a rigid insulating material with a cavity formed in one side having a bottom wall and a peripheral, generally cylindrical side wall having a groove formed therein intermediate the top and bottom of the cavity;

(b) an electrically conductive bottom contact member mounted in the case which extends from the bottom wall of the cavity to the outside of the case where it is exposed for connection to an electrical wire;

(c) a pressure plate having a radially extending flange with an outermost periphery conforming to the cylindrical periphery of the side wall of the cavity in the case, the pressure plate being mounted in the cavity in the case for up and down movement therein;

(d) an electrically insulating resilient annular member having a central aperture mounted between the pressure plate and the bottom wall of the cavity;

(e) means for holding the pressure plate in the cavity in the case and in contact with the resilient member while allowing the pressure plate to be moved toward the bottom of the cavity, including a compression ring adapted to fit under compression in the groove in the side wall of the cavity and to extend outwardly from the groove to engage the flange on the pressure plate to hold the same firmly in place against the resilient member; and (f) an electrically conductive top contact member mounted to the pressure plate having one end in opposed relation to the bottom contact mounted in the case and in position to make contact with the bottom contact member as the pressure plate is moved toward the bottom of the cavity, the top contact member adapted to be connected to an external electrical circuit.

11. A pressure responsive switch, comprising:

(a) a case made of a rigid insulating material having a cylindrical exterior and, integrally formed therewith, a pair of stabilizing protrusions extending radially outwardly from opposite sides of the case to allow mounting of the pressure switch, with a cavity formed in one side of the case having a bottom wall and a peripheral side wall;

(b) an electrically conductive bottom contact member mounted in the case which extends from the bottom wall of the cavity to the outside of the case where it is exposed for connection to an electrical wire;

(c) a pressure plate having an outermost periphery conforming to the side wall of the cavity in the case, the pressure plate being mounted in the cavity in the case for up and down movement therein;

(d) an electrically insulating resilient annular member having a central aperture mounted between the pressure plate and the bottom wall of the cavity;

(e) means for holding the pressure plate in the cavity in the case and in contact with the resilient member while allowing the pressure plate to be moved toward the bottom of the cavity whereby the resilient member will be compressed by the pressure plate; and (f) an electrically conductive top contact member mounted to the pressure plate having one end in opposed relation to the bottom contact mounted in the case and in position to make contact with the bottom contact member as the pressure plate is moved toward the bottom of the cavity, the top contact member adapted to be connected to an external electrical circuit.

12. A pressure responsive switch, comprising:

(a) a generally cylindrical case made of a rigid insulating material and having a generally cylindrical cavity formed in one side thereof with a cylindrical side wall and a flat bottom wall, the case having a central opening in the bottom wall of the cavity which extends through the case;

(b) an electrically conductive bottom contact member mounted in the central opening in the case having a head extending into the cavity at the bottom thereof and extending through the opening in the case to the outside of the case where it is exposed for connection to an electrical wire;

(c) a generally cylindrical pressure plate having a radially extending flange thereon with a circular outermost periphery generally conforming to the circular periphery of the cylindrical side wall of the cavity in the case, the pressure plate being mounted in the case for movement up and down in the cavity therein;

(d) an electrically insulating, resilient annular member having a central aperture mounted between the pressure plate and the bottom wall of the cavity;

(e) means for holding the pressure plate in the cavity in the case and in contact with the resilient member while allowing the pressure plate to be moved toward the bottom of the cavity whereby the resilient member will be compressed by the pressure plate;

(f) an electrically conductive top contact member adapted to be connected to an external electrical circuit and formed as a set screw and mounted in a threaded hole formed in the center of the pressure plate such that one end of the top contact member is positioned in opposed relation to the bottom contact member in the case with the top contact member in position to make contact with the bottom contact member when the pressure plate is urged toward the bottom of the cavity against the force of compression of the resilient member.

13. The pressure switch of claim 12 wherein the resilient annular member comprises a plurality of concentric O-rings formed of elastomer material.

14. The pressure switch of claim 12 wherein the top surface of the pressure plate is spaced slightly above the top of the case.

15. The pressure switch of claim 12 wherein the case has a groove formed in the cylindrical side wall of the cavity intermediate the top and the bottom of the cavity, and wherein the means for holding the pressure plate in the cavity includes a compression ring fitting under compression in the groove and extending outwardly from the groove to engage the flange on the pressure plate to hold the same firmly in place.

16. The pressure switch of claim 15 wherein the groove has a beveled top wall which engages the compression ring and tends to urge the compression ring downwardly against the flange on the pressure plate.

17. The pressure switch of claim 12 wherein the pressure plate has a hole formed in its periphery and has an electrical wire fixed in the hole to make electrical contact with the plate, and wherein an electrical wire is connected at the outside of the case to the bottom electrical contact member.

18. The pressure switch of claim 12 wherein the case includes a plurality of integrally formed posts extending away from the bottom of the cavity in evenly spaced relation, and wherein a plurality of holes are formed in the pressure plate which are adapted to admit the posts therethrough so that the pressure plate engages the posts and is held thereon to prevent the pressure plate from turning or twisting within the case.

* * * * *